US011044947B2

(12) United States Patent
Wu et al.

(10) Patent No.: US 11,044,947 B2
(45) Date of Patent: Jun. 29, 2021

(54) VAPORIZER AND LOW-TEMPERATURE BAKED SMOKING SET

(71) Applicant: Shenzhen First Union Technology Co., Ltd., Shenzhen (CN)

(72) Inventors: Zexin Wu, Shenzhen (CN); Yonghai Li, Shenzhen (CN); Zhongli Xu, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 354 days.

(21) Appl. No.: 16/172,729

(22) Filed: Oct. 27, 2018

(65) Prior Publication Data

US 2019/0124987 A1 May 2, 2019

(30) Foreign Application Priority Data

Oct. 27, 2017 (CN) ..... 201721428282.0

(51) Int. Cl.

| | |
|---|---|
| ***H05B 6/10*** | (2006.01) |
| ***A24F 40/465*** | (2020.01) |
| ***H05B 6/36*** | (2006.01) |
| ***A24F 47/00*** | (2020.01) |

(52) U.S. Cl.

CPC ..... *A24F 47/008* (2013.01); *A24F 40/465* (2020.01); *H05B 6/105* (2013.01); *H05B 6/108* (2013.01); *H05B 6/36* (2013.01)

(58) Field of Classification Search

CPC ..... A24F 40/465; H05B 6/105
USPC ..... 131/330
See application file for complete search history.

(56) References Cited

U.S. PATENT DOCUMENTS

| | | | | |
|---|---|---|---|---|
| 6,087,920 | A * | 7/2000 | Abramov | H01F 27/292 336/192 |
| 8,247,022 | B2 * | 8/2012 | Zhou | H01L 31/1868 427/74 |
| 2016/0120221 | A1 | 5/2016 | Mironov et al. | |
| 2017/0224015 | A1 | 8/2017 | Basil et al. | |
| 2020/0163385 | A1 * | 5/2020 | Courbat | A24F 40/48 |

FOREIGN PATENT DOCUMENTS

| | | | |
|---|---|---|---|
| CN | 206 227 716 | U | 6/2017 |
| WO | 95/27411 | A1 | 10/1995 |
| WO | 2016/023809 | A1 | 2/2016 |

* cited by examiner

*Primary Examiner* — Eric Yaary
*Assistant Examiner* — Russell E Sparks
(74) *Attorney, Agent, or Firm* — PROI Intellectual Property US; Klaus Michael Schmid

(57) ABSTRACT

A low-temperature baked vaporizer is disclosed, including an electromagnetic induction coil; and a sleeve, configured for receiving solid vaporizable materials; the sleeve is made from metallic materials; the electromagnetic induction coil encircles outside the sleeve; the sleeve includes a first sleeve and a second sleeve connected with the first sleeve; a longitudinal axis extending along a same axis direction of the first sleeve and the second sleeve, and a transverse axis that is perpendicular to and shorter that the longitudinal axis; a cross-sectional area of the first sleeve is smaller than that of the second sleeve along the transverse axis, and the second sleeve has a bigger mass than the first sleeve such that increasing rate of temperature of the second sleeve is slower than that of the first sleeve.

20 Claims, 5 Drawing Sheets

VAPORIZER AND LOW-TEMPERATURE BAKED SMOKING SET

TECHNICAL FIELD

The present disclosure relates to the field of smoking sets, and particularly, to a vaporizer and a low-temperature baked smoking set having same.

BACKGROUND ART

With the increasing amount of smoking people in our country, the tobacco cigarettes are applied all over the world. It is difficult to avoid the second hand smoking. The traditional cigarettes need to be lit by open flame to generate smoking smog. The tobacco cigarettes release lots of noxious materials to human people during high-temperature combustion. Most smokers already know the hazard of smoking, but can't control themselves, it is extremely difficult to get out of smoking.

Recently, a low-temperature baked smoking set mainly use some solid vaporizable materials such as tobacco shreds or opium paste etc. to be baked at a low-temperature to generate smoking smog for inhaling, which tremendously reduces the noxious materials to produce. The low-temperature baked smoking set generally includes a vaporizer for receiving and heating the tobacco cigarettes to generate smoking smog.

In the present disclosure, the inventors found the relative technologies of aforementioned have blow problems: in a process of the vaporizer being disposable heating the tobacco cigarette, the flavor and taste of smoking will be weakened at later stage, which causes different flavors at earlier and later stages to influence user experience.

SUMMARY

In view of the drawbacks in the prior art, the present disclosure relates to a vaporizer and a low-temperature baked smoking set have the same.

In order to solve the above technical problem, the present disclosure provides a low-temperature baked vaporizer according to independent claim 1 whereas various embodiments of the vaporizer and improvements thereto are recited in the dependent claims. The vaporizer includes an electromagnetic induction coil; a sleeve, configured for receiving solid vaporizable materials; the sleeve is made from metallic materials; the electromagnetic induction coil encircles outside the sleeve; the sleeve includes a first sleeve and a second sleeve connected with the first sleeve; a longitudinal axis extending along a same axis direction of the first sleeve and the second sleeve, and a transverse axis that is perpendicular to and shorter that the longitudinal axis; a cross-sectional area of the first sleeve is smaller than that of the second sleeve along the transverse axis, and the second sleeve has a bigger mass than the first sleeve such that increasing rate of temperature of the second sleeve is slower than that of the first sleeve.

Preferably, the sleeve is a hollow cylinder, the first sleeve has same inner diameter as the second sleeve.

Preferably, the electromagnetic induction coil encircles outside the first sleeve, configured for heating the sleeve.

Preferably, a number of turns of the electromagnetic induction coil is in accordance with a length of the first sleeve.

Preferably, the first sleeve and the second sleeve are made from same or different kinds of metallic materials.

Preferably, the first sleeve and the second sleeve are made from different metallic magnet materials; the first sleeve has a bigger magnetic permeability than the second sleeve.

Preferably, an insulating layer encircles outside the sleeve, configured for making less heat of the sleeve delivered to outside.

Preferably, the sleeve has a tobacco receptacle for receiving the solid tobacco materials.

Preferably, the vaporizer further includes a power supply module, coupled with the electromagnetic induction coil, and configured for supplying power to the electromagnetic induction coil.

Preferably, the electromagnetic induction coil includes a first interface and a second interface; the first interface and the second interface are coupled with the power supply module.

Preferably, an insulating layer is coated to the electromagnetic induction coil, configured for preventing leakage of electricity of the electromagnetic induction coil.

Preferably, the power supply module includes an USB interface, a battery, a control unit, a charging circuit, a discharging circuit, a voltage detecting circuit, two switches, a battery management circuit and a converter; the battery is coupled with the charging circuit and discharging circuit, two switches are respectively disposed between the battery and the charging circuit, and between the battery and the discharging circuit. The charging circuit and discharging circuit are both coupled with the USB interface. The discharging circuit is coupled with the battery management circuit. The battery management circuit is coupled with the converter. The converter is coupled with the electromagnetic induction coil. The voltage detecting circuit is coupled with the USB interface. The control unit is coupled with the two switches and the voltage detecting circuit.

To solve the above problem, the present disclosure further provides a low-temperature baked smoking set having a housing and the aforementioned vaporizer; the vaporizer is disposed inside the housing.

Additional aspects and advantages of the present disclosure will be: by relying on the vaporizer of the low-temperature baked smoking set, it includes the electromagnetic induction coil and the sleeve for receiving vaporizable materials; the sleeve is made from metallic materials, the electromagnetic induction coil encircles outside the sleeve, the sleeve includes a first sleeve and a second sleeve connected with the first sleeve, the cross-sectional area of the first sleeve is smaller than that of the second sleeve along the transverse axis, and the second sleeve has a bigger mass than the first sleeve such that increasing rate of temperature of the second sleeve is slower than that of the first sleeve, which may realize segment heating of the vaporizer, enable consistent flavor during smoking, improve user experience and reduce the cost.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The structure and operating principle of the above vaporizer and the low-temperature baked smoking set are illustrated below, mainly shown from FIG. 1 to FIG. 5 in further detail using exemplary embodiments.

Figure 1:
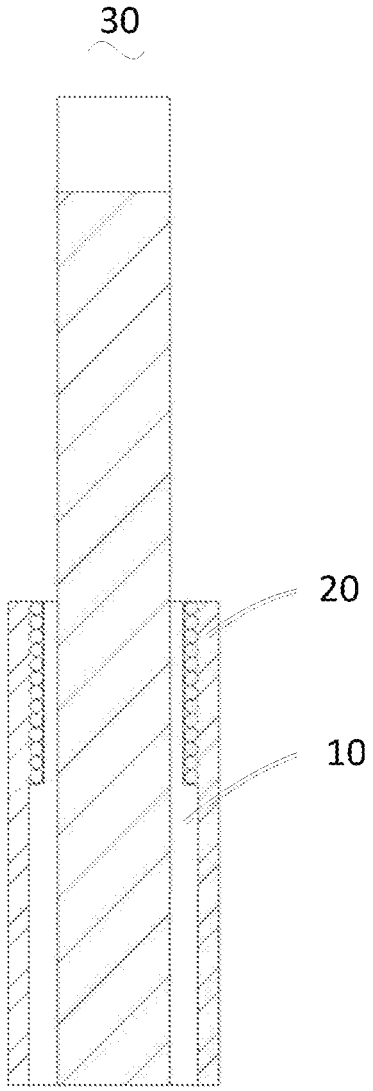
FIG. 1 is an aspect view of a low-temperature baked smoking set in accordance with one embodiment of the present disclosure.

Referring to FIG. 1, which is an aspect view of a low-temperature baked smoking set in accordance with one embodiment of the present disclosure; The low-temperature baked smoking set 30 includes a vaporizer 10 and a housing 20. The vaporizer 10*a* is accommodated inside the housing 20.

Figure 2:
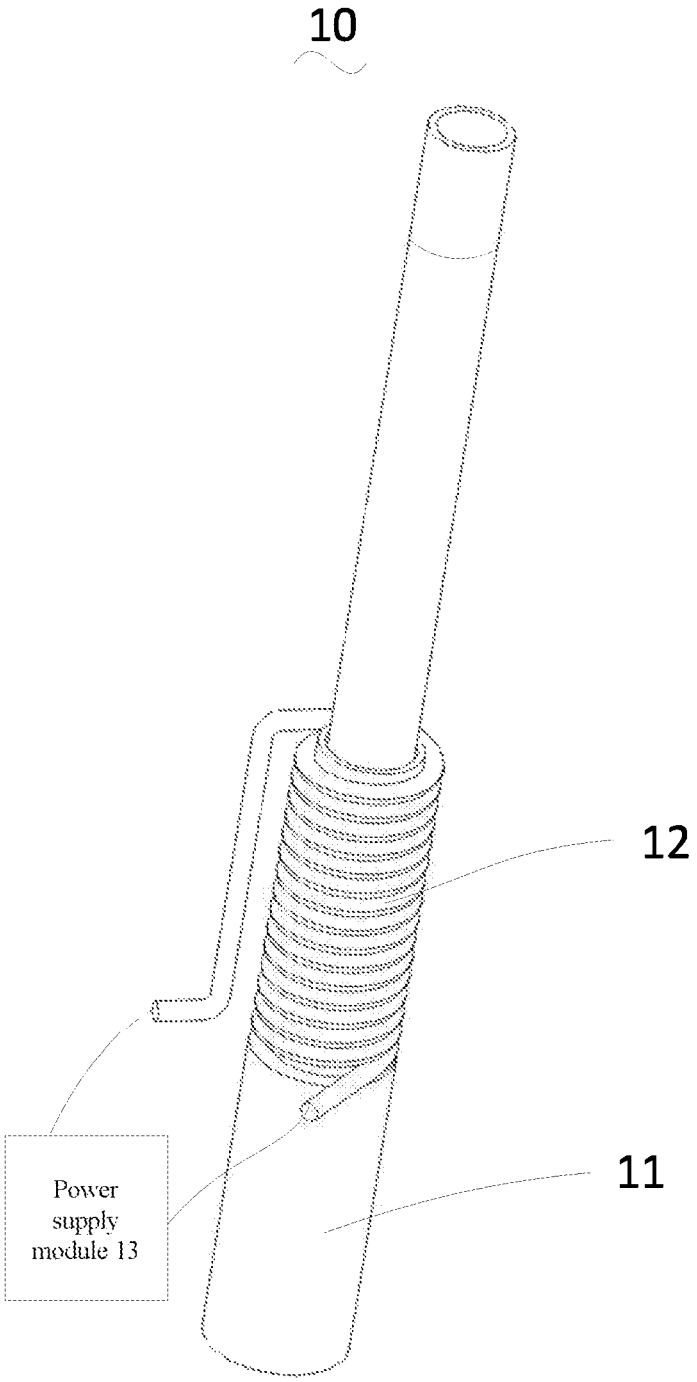
FIG. 2 is an isometric view of a vaporizer of the low-temperature baked smoking set in FIG. 1.

Referring to FIG. 2, the vaporizer 10 includes a sleeve 11, an electromagnetic induction coil 12 and a power supply 13. The sleeve 11 is configured for receiving solid vaporizable materials; the electromagnetic induction coil 12 encircles outside the sleeve 11 for heating the sleeve 11. The power supply module 13 is coupled with the electromagnetic induction coil 12 to output alternative current to generate an induction current.

Figure 3:
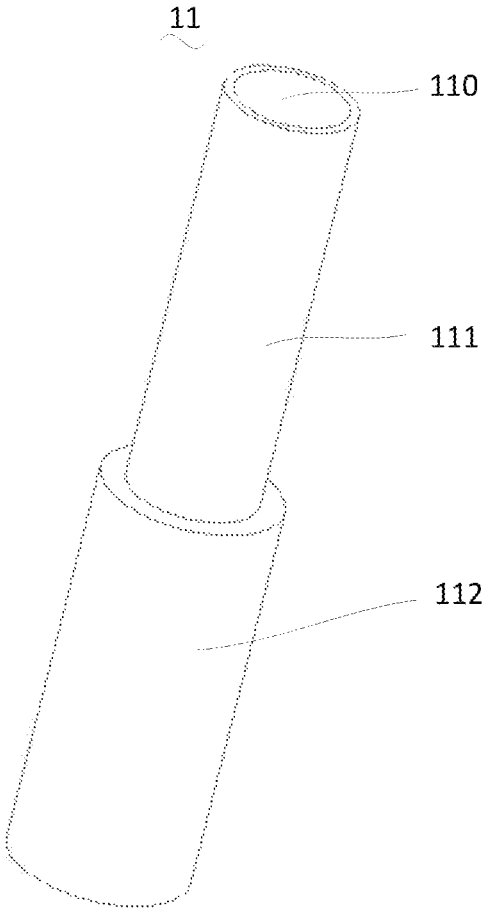
FIG. 3 is an isometric view of a sleeve of the low-temperature baked vaporizer in FIG. 1.

Referring to FIG. 3, the sleeve 11 is a hollow cylinder, the sleeve 11 is made from metallic materials, preferably magnetic materials to make the effect of inductive heating better, such as powdered iron core, FeNI50 alloys, FeSiAl alloys and FeNiMo alloys etc. The sleeve 11 includes a first sleeve 111 and a second sleeve 112 connected with the first sleeve 111; the second sleeve 112 has a bigger mass than the first sleeve 111 such that increasing rate of temperature of the second sleeve is slower than that of the first sleeve. For example, a longitudinal axis extending along a same axis direction of the first sleeve 111 and the second sleeve 112, and a transverse axis that is perpendicular to and shorter that the longitudinal axis; a cross-sectional area of the first sleeve 111 is equal with that of the second sleeve 112 along the transverse axis, and a length of the first sleeve 111 is shorter than that of the second sleeve 112 such that the second sleeve 112 has a bigger mass than the first sleeve 111. Or, the cross-sectional area of the first sleeve 111 is smaller than that of the second sleeve 112 along the transverse axis, the length of the first sleeve 111 is the same as that of the second sleeve 112 such that the second sleeve 112 has a bigger mass than the first sleeve 111. Or, the cross-sectional area of the first sleeve 111 is smaller than that of the second sleeve 112 along the transverse axis, the length of the first sleeve 111 is shorter than that of the second sleeve 112 such that the second sleeve 112 has a bigger mass than the first sleeve 111. Preferably, the cross-sectional area of the first sleeve 111 is smaller than that of the second sleeve 112 along the transverse axis, and inner diameter of the first sleeve 111 is equal with that of the second sleeve 112, the outer diameter of the first sleeve 111 is less than that of the second sleeve 112, let the solid vaporizable materials abut against inside of the sleeve 11

The sleeve 11 is heated by induction heating of the electromagnetic induction coil 12, since the cross-sectional area of the first sleeve 111 is smaller than that of the second sleeve 112 along the transverse axis, and the second sleeve 112 has a bigger mass than the first sleeve 111, according to a heat quantity calculation formula: $Q=c*m*\Delta T$, of which, c is the specific heat capacity, m is the mass, $\Delta T$ is the changing temperature and Q is the heat quantity; and a power calculation formula: $P=W/t$, of which, P is the electric power, W is the electric work, t is the time, presuming the energy conversion efficiency $\eta$ is $Q=W*\eta$, then $P*t=c*m*\Delta T*\eta$, therefore, when P is a constant, objects with same materials that have same specific heat capacity, if the object has bigger mass m, then the object need more time to rise to a same temperature. Therefore, during heating the sleeve 11, since the second sleeve 112 has a bigger mass than the first sleeve 111, the first sleeve 11 needs less time to rise to a preset temperature, but the second sleeve 112 needs more time to rise to the preset temperature, which may realize the segment heating.

An insulating layer (not shown) encircles outside the sleeve 11, configured for making less heat of the sleeve 11 delivered to outside. The insulating layer is made from thermal insulation materials, such as, thermal insulation glue, aerogel, asbestos, aluminum silicate and calcium silicate etc. The insulating layer may further improve thermal efficiency and heat preservation effect, making the heating rate faster.

The sleeve 11 has a tobacco receptacle 110 for receiving the solid tobacco materials. For example, the solid tobacco materials is at least one or more selected from a group of tobacco shreds, tobacco sheets, tobacco powders and tobacco rods.

In some embodiment, it makes sense that the first sleeve 111 and second sleeve 112 are both made from same metallic magnetic materials or different metallic magnetic materials, such as the first sleeve 111 and the second sleeve 112 are both made from a same kind of metallic magnetic material, or the first sleeve 111 is made from a kind of metallic magnetic material and the second sleeve 112 is made from another kind of metallic magnetic material. When the first sleeve 111 and the second sleeve 112 are made from different metallic magnetic materials, the first sleeve 111 has a larger magnetic permeability than the second sleeve112, so when the electromagnetic induction coil 12 heats the sleeve 11, the first sleeve 111 generates larger amount of heat than the second sleeve 112, therefore realizing segment heating.

In some embodiment, it makes sense that the cross-section of the sleeve 11 is shaped as square, rectangular or irregular quadrilateral etc. just to guarantee that the sleeve 11 is able to receive the solid vaporizable materials and the second sleeve 112 has a bigger mass than the first sleeve 111.

In some embodiment, the sleeve 111 is a hollow body, the cross-sectional area refers to entity part of the body, such as, if the sleeve 11 is a hollow cylinder, the cross-section is a annular, so cross-sectional area is the area of the annular.

Figure 4:
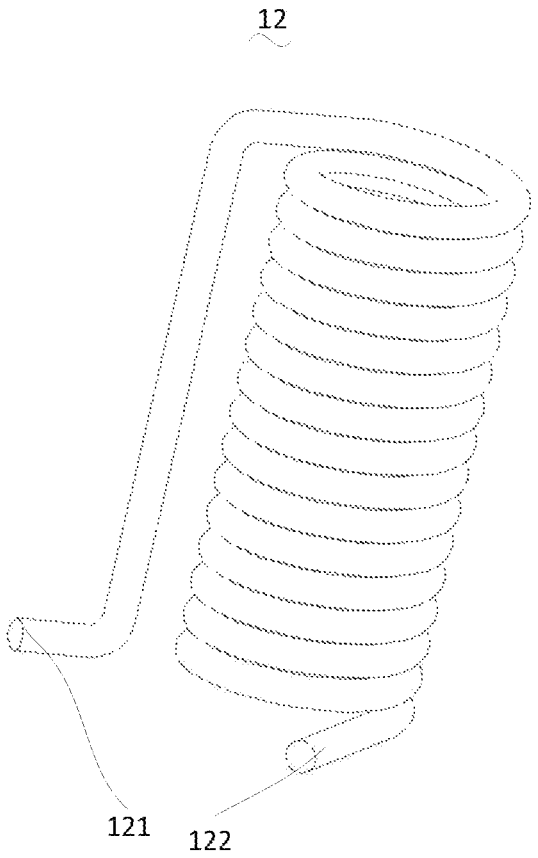
FIG. 4 is an isometric view of an electromagnetic induction coil of the low-temperature baked vaporizer in FIG. 1.

Referring to FIG. 4, the above electromagnetic induction coil 12 encircles outside the sleeve 11 following an unified direction, to exert inductive heating around the sleeve 11. The electromagnetic induction coil 12 may be made by electric-conductive materials, such as copper wires or aluminum wires etc. with good electric-conduction but cheap price. Preferably, the electromagnetic induction coil 12 encircles outside the first sleeve 111 to heat the first sleeve 111. A number of turns of the electromagnetic induction coil 12 is in accordance with a length of the first sleeve 111. When the electromagnetic induction coil 12 is electrified, by relying on the inductive heating, the temperature of the first sleeve 111 is risen soon, meanwhile, since the electromagnetic induction coil 12 encircles outside the first sleeve 111, the temperature of the second sleeve 112 is risen by heat conductivity from the first sleeve 111. If the heat of conductivity is constant, the first sleeve 111 has a smaller cross-sectional area and a smaller mass than the second sleeve 112, but in same material, after the heat conductivity is finished, based on the formula: $Q=c*m*\Delta T$, of which, c is the specific heat capacity, m is the mass, $\Delta T$ is the changing temperature and Q is the heat quantity; if Q is the constant, when c is the constant, larger m, then $\Delta T$ is more slighter. So at a certain moment, the temperature of the second sleeve 112 is permanently lower than that of the first sleeve 111, with consequently realizing segment heating. For example, when the first sleeve 111 is heated to 30° C., the temperature of the second sleeve 112 won't be risen to 30° C. until 30 seconds later; when the first sleeve 111 is continuously heated to 40° C., after the 30 seconds, the temperature of the second sleeve 112 won't be risen to 40° C. until 10 seconds later.

The electromagnetic induction coil 12 includes a first interface 121 and a second interface 122; the first interface 121 and the second interface 122 are coupled with the power supply module 13 configured for supplying power to the electromagnetic induction coil 12, so the electromagnetic induction coil 12 generates the electromagnetic induction. Based on the electromagnetic induction law, when the electromagnetic induction coil 12 is electrified with the alternative current, the electromagnetic induction coil 12 generates alternative magnetic flux inside, the alternative magnetic flux generates induced potential inside the sleeve 11, meanwhile when magnetic lines of force in the magnetic field passes through the sleeve 11, the alternative magnetic lines of force forms a loop inside the sleeve 11, and the cross-sectional area of the sleeve 11 generates the inductive current, that is vortex, for heating the sleeve 11.

In some embodiment, it makes sense that the electromagnetic induction coil 12 is able to extend into the tobacco receptacle 110, or be embedded inside of the first sleeve 111, just to guarantee that the first sleeve 111 is inducted by the magnetic field to generate heat. In other embodiments, the number of the electromagnetic induction coils 12 is two, including a first coil and a second coil (not shown). The first coil and the second coil both encircle outside the first sleeve 111, the first coil and the second coil may have different turns of coil to change the heating rate of the sleeve 11, which is more flexible to adjust the heating effect.

In some embodiment, it makes sense that the number of turns of the electromagnetic induction coils 12 may be more than or less than the length of the first sleeve 111, the number may be determined by the cross-sectional area of the electromagnetic induction coils 12 and the cross-sectional area of the first sleeve 111.

In some embodiment, it makes sense that an insulating layer is coated to the electromagnetic induction coil 12, configured for preventing leakage of electricity of the electromagnetic induction coil 12. The insulating layer is made by insulating materials such as, synthetic resin, epoxy resin, phenolic resin, 4250-plastic and polyimide plastic etc.

Figure 5:
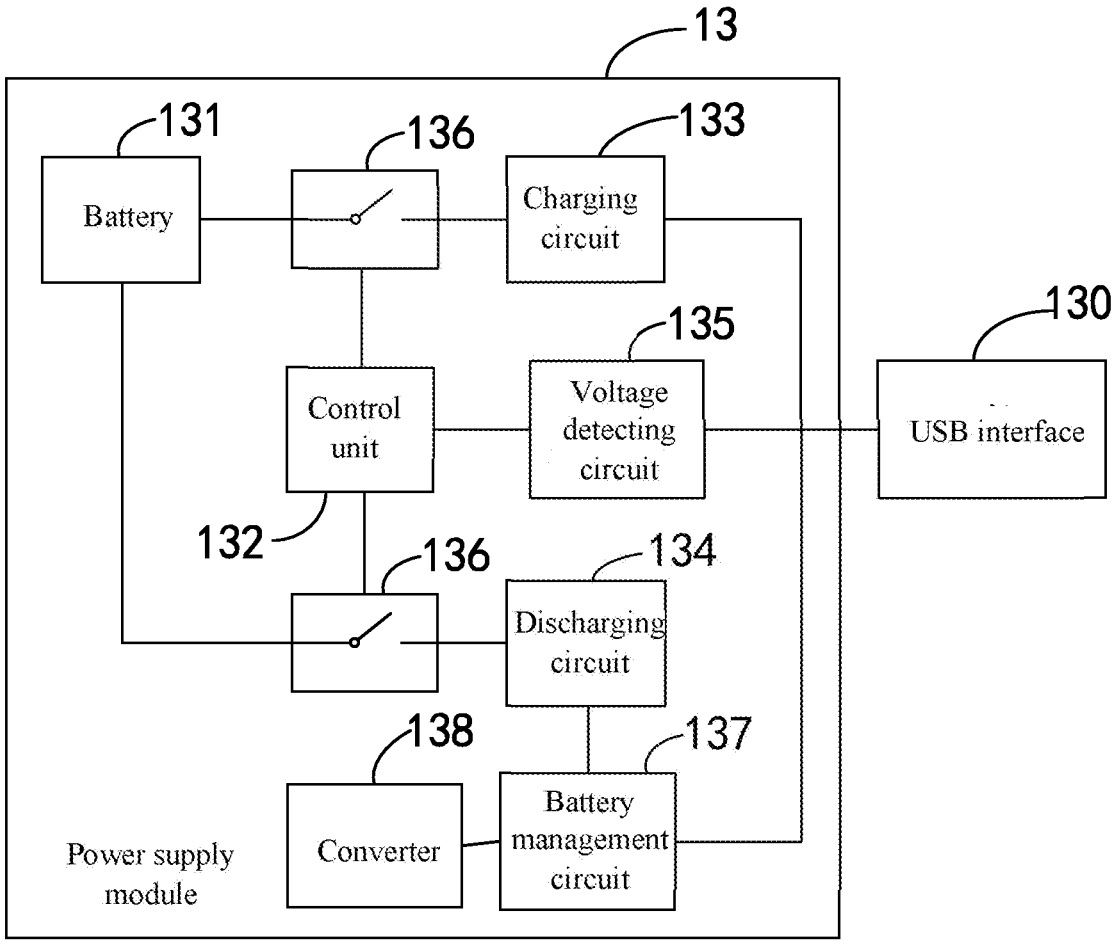
FIG. 5 is a block diagram of a power supply module of the low-temperature baked vaporizer in FIG. 1.

Referring to FIG. 5, the above power supply module 13 is coupled with the first interface 121 and the second interface respectively, that means coupled with the electromagnetic induction coil 12. The power supply module 13 includes an USB interface 130, a battery 131, a control unit 132, a charging circuit 133, a discharging circuit 134, a voltage detecting circuit 135, two switches 136, a battery management circuit 137 and a converter 138; the battery 131 is coupled with the charging circuit 133 and discharging circuit 134, two switches 136 are respectively disposed between the battery 131 and the charging circuit 133, and between the battery 131 and the discharging circuit 134. The charging circuit 133 and discharging circuit 134 are both coupled with the USB interface 130 to be coupled with the external power supply. The voltage detecting circuit 135 is coupled with the USB interface 130, for detecting weather the power supply module 13 is coupled with the external power supply. The control unit 132 is coupled with the two switches 136 and the voltage detecting circuit 135. The discharging circuit 134 is coupled with the battery management circuit 137. The battery management circuit 137 is coupled with the converter 138 configured for direct current conversed to alternative current. The converter 138 is coupled with the electromagnetic induction coil 12 for supplying power to the electromagnetic induction coil 12. If the voltage detecting circuit 135 detects a voltage, that means the power supply module 13 is coupled with external power supply, then an electrical signal is sent to the control unit 132, after receiving the electrical signal, the control unit 132 controls the switch 136 between the battery 131 and the charging circuit 133 from "off" state alternative to "on" state, the external power supply supplies power to the battery 131 by current from the external power supply passing the charging circuit 133. If the voltage detecting circuit 135 fails to detect a voltage, that means, the power supply module 13 fails to be electrified with the external power supply, the control unit 132 generates another electrical signal, after the control unit 132 receives the electrical signal, the control unit 132 controls another switch 136 between the battery 131 and the discharge circuit 134 from "off" state alternative to "on" state. The current of the battery flows towards the converter 138 via the discharging circuit 134 and the battery management circuit 137. The converter 138 may convert the direct current into the alternative current, therefore supplying power to the electromagnetic induction coil 12.

In terms of the vaporizer 10 in the present disclosure, the second sleeve 112 has a bigger mass than the first sleeve 111, a cross-sectional area of the first sleeve 111 is smaller than that of the second sleeve 112 along the transverse axis, that means, that increasing rate of temperature of the second sleeve 112 is slower than that of the first sleeve 111, therefore, the segment heating of the vaporizer 10 is realized, enabling consistent flavor during smoking, improving user experience and reducing the cost.

In the embodiments, the sleeve 11 is a nearly hollow cylinder, for receiving the vaporizer 10. The housing 20 may be a plastic housing, made of some heat preservation materials such as polycarbonate, polyurethane and polyimide etc. In other embodiments, the housing 20 may be made of metallic, coating plastic film on the housing 20 to achieve the heat preservation effect.

The low-temperature baked smoking set 30 in accordance with the embodiments of the present disclosure, includes the vaporizer 10 available of segment heating that makes the flavor consistent during being inhaled, effectively improves the user experience. Compared with the resistance heating in the prior art, it has lower price.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. A low-temperature baked vaporizer, comprising:

an electromagnetic induction coil; and a sleeve, configured for receiving solid vaporizable materials; the sleeve is made from metallic materials;

wherein, the electromagnetic induction coil encircles outside the sleeve; the sleeve comprises a first sleeve and a second sleeve connected with the first sleeve;

a longitudinal axis extending along a same axis direction of the first sleeve and the second sleeve, and a transverse axis that is perpendicular to and shorter that the longitudinal axis; a cross-sectional area of the first sleeve is smaller than that of the second sleeve along the transverse axis, and the second sleeve has a bigger mass than the first sleeve such that a rate of temperature increase of the second sleeve is slower than that of the first sleeve.

2. The vaporizer according to claim 1, wherein, the sleeve is a hollow cylinder, the first sleeve has same inner diameter as the second sleeve.

3. The vaporizer according to claim 1, wherein, the electromagnetic induction coil encircles outside the first sleeve, configured for heating the sleeve.

4. The vaporizer according to claim 3, wherein, a number of turns of the electromagnetic induction coil is in accordance with a length of the first sleeve.

5. The vaporizer according to claim 1, wherein, the first sleeve and the second sleeve are made from different kinds of metallic materials.

6. The vaporizer according to claim 5, wherein, the first sleeve and the second sleeve are made from different metallic magnet materials; the first sleeve has a bigger magnetic permeability than the second sleeve.

7. The vaporizer according to claim 1, wherein, an insulating layer encircles outside the sleeve, configured for making less heat of the sleeve delivered to outside.

8. The vaporizer according to claim 1, wherein, the sleeve comprises a tobacco receptacle for receiving solid vaporizable materials.

9. The vaporizer according to claim 1, wherein, the vaporizer further comprises a power supply module, coupled with the electromagnetic induction coil, and configured for supplying power to the electromagnetic induction coil.

10. The vaporizer according to claim 9, wherein, the electromagnetic induction coil comprises a first interface and a second interface; the first interface and the second interface are coupled with the power supply module.

11. The vaporizer according to claim 10, wherein, an insulating layer is coated to the electromagnetic induction coil, configured for preventing leakage of electricity of the electromagnetic induction coil.

12. The vaporizer according to claim 11, wherein, the power supply module comprises an USB interface, a battery, a control unit, a charging circuit, a discharging circuit, a voltage detecting circuit, two switches, a battery management circuit and a converter; the battery is coupled with the charging circuit and discharging circuit, two switches are respectively disposed between the battery and the charging circuit, and between the battery and the discharging circuit; the charging circuit and discharging circuit are both coupled with the USB interface; the discharging circuit is coupled with the battery management circuit; the battery management circuit is coupled with the converter; the converter is coupled with the electromagnetic induction coil, the voltage detecting circuit is coupled with the USB interface; the control unit is coupled with the two switches and the voltage detecting circuit.

13. A low-temperature baked smoking set, comprising a housing; and a vaporizer, disposed inside the housing and comprising:

an electromagnetic induction coil; and a sleeve, configured for receiving solid vaporizable materials; the sleeve is made from metallic materials;

wherein, the electromagnetic induction coil encircles outside the sleeve; the sleeve comprises a first sleeve and a second sleeve connected with the first sleeve; a longitudinal axis extending along a same axis direction of the first sleeve and the second sleeve, and a transverse axis that is perpendicular to and shorter that the longitudinal axis; a cross-sectional area of the first sleeve is smaller than that of the second sleeve along the transverse axis, and the second sleeve has a bigger mass than the first sleeve such that a rate of temperature increase of the second sleeve is slower than that of the first sleeve.

14. The low-temperature baked smoking set according to claim 13, wherein, the sleeve is a hollow cylinder, the first sleeve has same inner diameter as the second sleeve.

15. The low-temperature baked smoking set according to claim 13, wherein, the electromagnetic induction coil encircles outside the first sleeve, configured for heating the sleeve.

16. The low-temperature baked smoking set according to claim 15, wherein, a number of turns of the electromagnetic induction coil is in accordance with a length of the first sleeve.

17. The low-temperature baked smoking set according to claim 13, wherein, the first sleeve and the second sleeve are made from different kinds of metallic materials.

18. The low-temperature baked smoking set according to claim 17, wherein, the first sleeve and the second sleeve are made from different metallic magnet materials; the first sleeve has a bigger magnetic permeability than the second sleeve.

19. The low-temperature baked smoking set according to claim 13, wherein, an insulating layer encircles outside the sleeve, configured for making less heat of the sleeve delivered to outside.

20. The low-temperature baked smoking set according to claim 13, wherein, the sleeve comprises a tobacco receptacle for receiving the solid vaporizable materials.

* * * * *